US010239274B2

(12) United States Patent
Sprague et al.

(10) Patent No.: US 10,239,274 B2
(45) Date of Patent: Mar. 26, 2019

(54) INTERSECTING DIE LIFTING SYSTEM

(71) Applicant: Wardcraft Conveyor, a Division of McLaughlin Ward & Co., Spring Arbor, MI (US)

(72) Inventors: Patrick Sprague, Jackson, MI (US); James M. Snyder, Spring Arbor, MI (US)

(73) Assignee: Wardcraft Conveyor, a Division of McLaughlin Ward & Co., Spring Arbor, MI (US)

( * ) Notice: Subject to any disclaimer, the term of this patent is extended or adjusted under 35 U.S.C. 154(b) by 87 days.

(21) Appl. No.: 15/535,165

(22) PCT Filed: Aug. 4, 2015

(86) PCT No.: PCT/US2015/043528
§ 371 (c)(1),
(2) Date: Jun. 12, 2017

(87) PCT Pub. No.: WO2016/140700
PCT Pub. Date: Sep. 9, 2016

(65) Prior Publication Data

US 2017/0348938 A1 Dec. 7, 2017

Related U.S. Application Data

(60) Provisional application No. 62/126,953, filed on Mar. 2, 2015.

(51) Int. Cl.
*B30B 15/02* (2006.01)

(52) U.S. Cl.
CPC ..... *B30B 15/028* (2013.01)

(58) Field of Classification Search
CPC ..... B30B 15/028
USPC ..... 198/361, 369.6, 370.09, 371.3, 457.02, 198/782; 193/35 SS
See application file for complete search history.

(56) References Cited

U.S. PATENT DOCUMENTS

| | | | |
|---|---|---|---|
| 3,011,665 | A | 12/1961 | Wise |
| 3,645,379 | A | 2/1972 | Kornylak |
| 3,710,917 | A | 1/1973 | Black et al. |
| 4,498,384 | A | 2/1985 | Murphy |

(Continued)

FOREIGN PATENT DOCUMENTS

| | | | |
|---|---|---|---|
| DE | 3109219 | A1 | 7/1982 |
| JP | 2011225376 | A | 11/2011 |

*Primary Examiner* — Gene O Crawford
*Assistant Examiner* — Lester Rushin, III
(74) *Attorney, Agent, or Firm* — Endurance Law Group PLC

(57) ABSTRACT

A pneumatic die transfer system for a press machine comprises at least two primary roller rails and at least two secondary roller rails set in respective T-slots in a bolster. The primary roller rails are perpendicular to the secondary roller rails. Airbags below each roller rail are selectively inflated to elevate either the primary or the secondary roller rails above the bolster face. The secondary roller rails each have a plurality of discontinuities configured to receive the primary roller rails and their associated airbags in an intersecting fashion. As a result, the bolster can be easily fabricated with intersecting T-slots and relatively few roller rails are needed to achieve fully orthogonal conveyance of a heavy die over the face of a bolster.

20 Claims, 9 Drawing Sheets

(56) References Cited

U.S. PATENT DOCUMENTS

| | | | | |
|---|---|---|---|---|
| 4,691,554 | A | 9/1987 | Murphy | |
| 4,700,624 | A | 10/1987 | Murphy | |
| 4,819,554 | A * | 4/1989 | Fleischer ..... | B23Q 1/40 100/224 |
| 5,042,633 | A | 8/1991 | Jenkner | |
| 5,947,676 | A | 9/1999 | Richard | |
| 6,382,385 | B2 | 5/2002 | Ransil et al. | |
| 6,422,372 | B2 | 7/2002 | Ransil | |
| 7,204,793 | B2 | 4/2007 | Hedin | |

* cited by examiner

FIG. 3
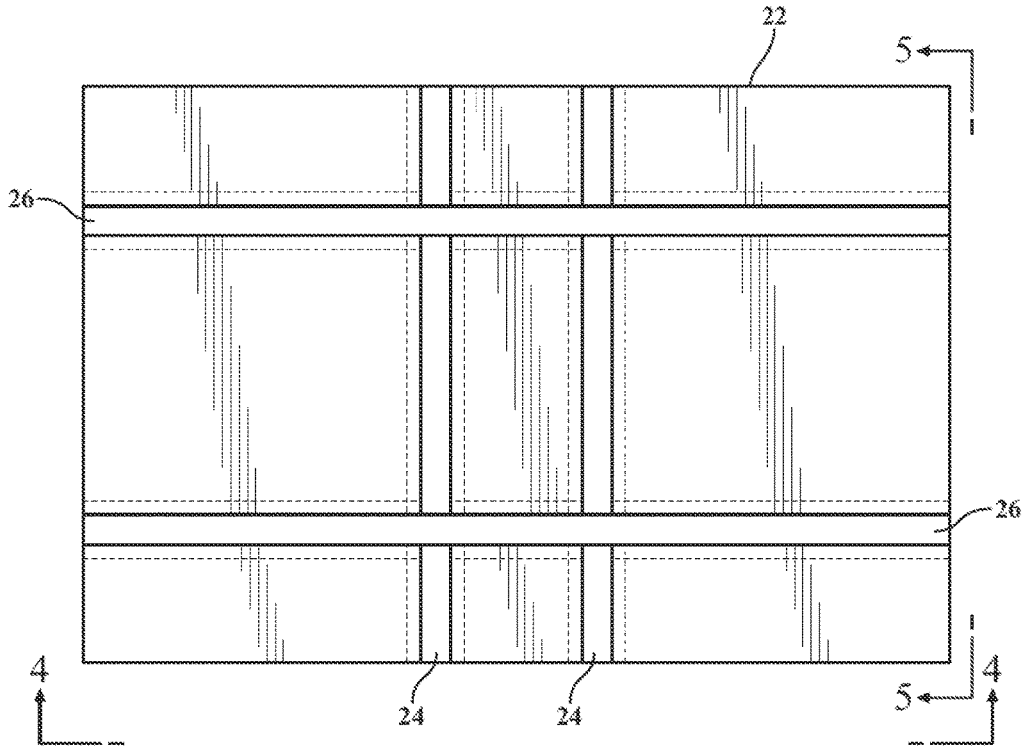
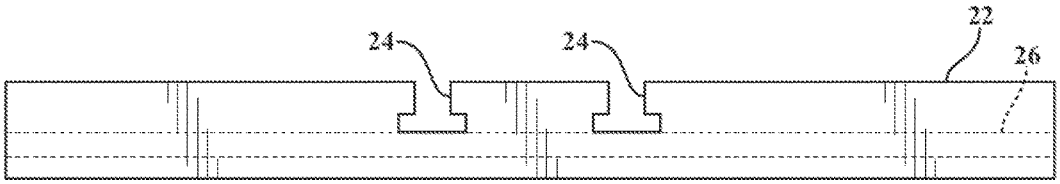
FIG. 4

INTERSECTING DIE LIFTING SYSTEM

CROSS REFERENCE TO RELATED APPLICATIONS

This application claims priority to Provisional Patent Application No. 62/126,953 filed Mar. 2, 2015, the entire disclosure of which is hereby incorporated by reference and relied upon.

BACKGROUND OF THE INVENTION

Field of the Invention

The invention relates generally to self-loading or unloading vehicles for conveyor devices where a load is guided or supported by at least one roller that can be raised and lowered, and more particularly to a die transfer system for a press machine.

Description of Related Art

Relatively heavy stamping, forging, die casting and plastic injection molding dies often present a handling problem when such dies are assembled with or removed from the bolster of a press machine. For example, U.S. Pat. No. 5,947,676 to Richard, issued Sep. 7, 1999, discloses a die lift system that uses a silicone airbag in conjunction with a specially configured compressed air manifold, like that illustrated in FIG. 1. A series of parallel channels, in the form of T-slots, are formed in the bolster. An airbag is placed in at least two channels and each are connected to a source of compressed air via a manifold. Roller rails are placed in the channels over the airbags to be raised/lowered in conjunction with inflation/deflation of the respective airbags. When a die is affixed to the bolster during normal operation of the press machine, the airbags are deflated and the roller rails retracted below the face of the bolster so as not to interfere with the secure placement of the die. However, when it is desired to move the die off the bolster, the airbags are simultaneously inflated thereby elevating the bottom of the die above the bolster face by the several roller elements in each of the roller rails. Suspended by the roller elements, the die can then be easily moved in a path parallel to the roller rails. The Richard '676 patent is assigned to the assignee of the present invention, and the entire disclosure thereof is hereby incorporated by reference and relied upon. Other examples of T-slot and airbag type die lift systems may be found in U.S. Pat. Nos. 4,498,384, 4,691,554 and 4,700,624 to Murphy, the disclosures of which are also incorporated by reference and relied upon.

Sometimes, it is desirable for a technician or millwright to be able to manually move a die in two orthogonal directions on a bolster, for example forward-to-backward and left-to-right. The prior art has offered some examples of die lift systems that will enable a technician or millwright to be able to manually move a die in two orthogonal directions on a bolster, but all have shortcomings. For example, U.S. Pat. No. 3,011,665 to Wise, issued Dec. 5, 1961, discloses a roller conveyor system that is capable of transferring objects in two perpendicular directions (i.e., in the X and Y directions of a horizontal plane). The Wise '665 system is designed with rollers carried in trays that are held in channels in the system bed. All of the channels in the bed are parallel, and all of the roller trays are likewise arranged parallel to one another. Half of the roller trays have rollers that are supported on axles so as to transfer objects in the "X" direction. The rollers in the other half of the roller trays are supported on axles so as to transfer objects in the "Y" direction. The "X" direction trays are alternated between the "Y" direction trays. Air bladders are placed under the roller trays. The air bladders are selectively inflatable to raise all of the "X" direction trays in unison while the "Y" direction trays remain low. Alternatively, the air bladders underneath the "Y" direction trays can be inflated in unison while the "X" direction trays remain low. In this manner, objects can be moved in either the "X" or "Y" direction depending upon which set of roller trays are raised. A relatively large number of channels and rails need to be provided in the bolster for smooth rolling transfer in the directions perpendicular to the channels. That is to say, the Wise '665 system requires significantly more than two roller rails for conveying dies perpendicular to the channels.

In another example, U.S. Pat. No. 4,819,554 to Fleischer et al., issued Apr. 11, 1989, describes a roller conveyor system that is capable of transferring objects in two perpendicular directions (X-Y). The rollers are held in trays, which in turn are located in channels in the system bed. Air bladders are placed under the roller trays, and are selectively inflatable to raise all of the "X" direction (or alternatively the "Y" direction) trays in unison while the other trays remain low. In the embodiment of Fleischer's FIG. 3, the channels are formed so that the "X" direction channels do not intersect the "Y" direction channels. And likewise, the "X" & "Y" roller trays do not intersect. This complicates fabrication of the bolster, and also complicates installation of the roller tray system and its air connections.

German Patent No. DE3109219 to Streit, published Jul. 8, 1982, shows yet another example of a material handling system that is capable of transferring objects in two perpendicular directions (X-Y). In this system, large primary (live) rollers do not raise or lower; they are fixed in position. Smaller transverse rollers are raised or lowered below the tops of the large live rollers in order to switch between "X" and "Y" direction transfers. The system is therefore ill-suited to many forms of modern-day press machine operations.

There is therefore a need in the art for an improved die transfer system that retains the functionally flawless performance of the Richard '676 patent, but yet allows a technician or millwright to manually move a die in two orthogonal directions on the bolster. The improved system must be relatively low-cost, easy to install and maintain, and robust.

BRIEF SUMMARY OF THE INVENTION

According to a first aspect of this invention. A pneumatic die transfer system for a press machine comprises at least two primary roller rails disposed parallel to one another. Each primary roller rail comprises an elongated U-channel supported over a primary base plate. Each primary base plate includes a pair of laterally extending primary flanges. A lateral measurement across the primary flanges comprises a primary flange width. The height of the primary flanges comprises a primary flange thickness. At least two elongated first airbags are provided. Each first airbag is disposed below a respective one of the primary roller rails. Each first airbag is configured to inflate to an inflated height in response to an admittance of compressed air and thereby elevate the respective primary roller rail. At least two secondary roller rails are disposed parallel to one another. Each secondary roller rail comprises an elongated U-channel supported over a secondary base plate. At least two elongated second airbags are provided. Each second airbag is disposed below a respective one of the secondary roller rails. Each second airbag is configured to inflate in response to an admittance of compressed air and thereby elevate the respective secondary roller rail. Each secondary roller rail includes a plurality of discontinuities in the U-channel thereof. Each discontinuity corresponding to a respective one of the primary roller rails. Each discontinuity is under-girded by the secondary base plate. Each discontinuity has a longitudinal gap spacing. The longitudinal gap spacing is at least as large as the primary flange width in order to receive in the discontinuity and above the under-girded secondary base plate a transversely oriented one of the primary rails together with the respective first airbag, whereby the at least two primary roller rails intersect the at least two secondary roller rails in a grid pattern while remaining selectively operable by the respective first and second airbags to facilitate manual transfer of a forming die in the linear direction of either the primary or secondary roller rails.

According to another aspect of this invention, a combination die transfer system and press machine is provided. The press machine includes a bolster having a generally horizontal face. A plurality of T-slots are formed in the face of the bolster, each with opposing undercut sections that establish shoulder stop features. Each T-slot has a respective length. The T-slots comprise at least two shallow T-slots and at least two deep T-slots. The shallow T-slots are disposed parallel to one another. The deep T-slots are parallel to each other, and perpendicularly intersect the shallow T-slots. A primary roller rail is disposed in each of the shallow T-slots, and each primary roller rail has a length generally corresponding to the length of the respective shallow T-slots and/or to the required die travel requirements. Each primary roller rail comprises an elongated U-channel supported over a primary base plate. Each primary base plate includes a pair of laterally extending primary flanges. A lateral measurement across the primary flanges comprises a primary flange width. The height of the primary flanges comprises a primary flange thickness. The primary flanges are fitted within the opposing undercut sections of the shallow T-slots. Vertical movement of each primary roller rail within the respective shallow T-slot is constrained by the shoulder stops. An elongated first airbag is disposed within each shallow T-slot, and is disposed below a respective primary roller rail. Each first airbag is configured to inflate to an inflated height in response to receiving a supply of compressed air and thereby elevate the respective primary roller rail within the associated shallow T-slot so that the plurality of roller elements protrude above the bolster face. An elongated second airbag is disposed within each deep T-slot. Each second airbag is disposed below the respective secondary roller rail, and is configured to inflate in response to receiving a supply of compressed air so as to elevate the respective secondary roller rail within the associated deep T-slot. A secondary roller rail is disposed in each of the deep T-slots. Each secondary roller rail comprises an elongated U-channel supported over a secondary base plate. Each secondary roller rail includes a plurality of discontinuities in the U-channel. Each discontinuity corresponds to a respective one of the primary roller rails, and is under-girded by the secondary base plate. Each discontinuity has a longitudinal gap spacing that is at least as large as the primary flange width in order to receive therein a transversely oriented primary rail together with its first airbag.

The present invention enables an improved die transfer system that retains the functionally flawless performance of the Richard '676 patent, but yet allows a technician or millwright to manually move a die in two orthogonal directions on the bolster. The present invention can be constructed at relatively low-cost, is easy to install and maintain, and is robust.

BRIEF DESCRIPTION OF THE SEVERAL VIEWS OF THE DRAWINGS

These and other features and advantages of the present invention will become more readily appreciated when considered in connection with the following detailed description and appended drawings, wherein:

FIG. 3 is a top view of a bolster in which are formed orthogonally intersecting T-slots to accommodate the die transfer system of the present invention;

FIG. 4 is a front view of the bolster as taken generally along lines 4-4 of FIG. 3;

DETAILED DESCRIPTION OF THE INVENTION

Referring to the figures, wherein like numerals indicate like or corresponding parts throughout the several views, a die transfer system for a press machine 18 is generally shown at 20. The term press machine 18 is used herein broadly to describe any type of industrial machine used to cut and/or shape a working material, such as metal or plastic, between two tool parts. When configured as a stamping press, for example, the press machine 18 shapes and/or cuts metal by deforming the metal between two dies. Alternatively, a press machine 18 configured for injection molding forms plastic products in a cavity between two dies.

Figure 2:
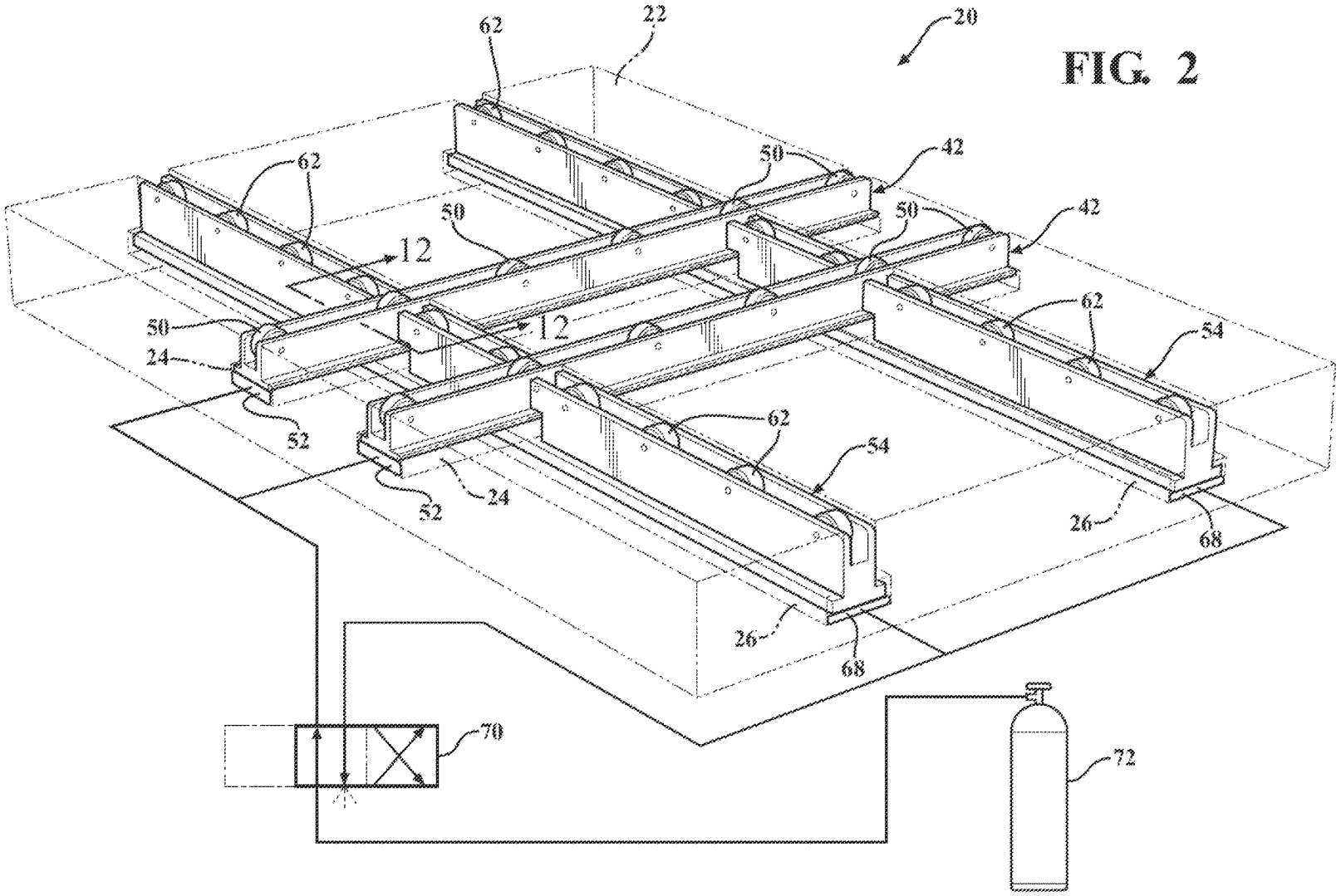
FIG. 2 is a perspective view of a novel die transfer system according to one embodiment of the present invention shown fitted in a bolster which is depicted in phantom lines and schematically connected to a supply of compressed air.

The typical press machine 18 has a bolster 22 and a ram (not shown). The ram is moveable vertically in relation to the bolster 22 and provides the stroke (up and down movement). The bolster 22 (also known as a bolster plate or bed) is often a large block of stationary metal having a generally horizontal face, as perhaps best shown in FIG. 3. A plurality of T-slots are cut into the bolster 22. Preferably, but not necessarily, the T-slots extend from edge-to-edge of the bolster 22, such that the length of each T-slot corresponds to the length or width of the bolster 22 according to its respective orientation. In order to accommodate the die transfer system 20 of the present invention as depicted in FIG. 2, the T-slots will comprise at least two shallow T-slots 24 and at least two deep T-slots 26. The two shallow T-slots 24 are disposed parallel to one another. Similarly the two deep T-slots 26 are disposed parallel to one another. These T-slot sets 24, 26 are oriented orthogonally to one another, so that the two shallow T-slots 24 perpendicularly intersect the two deep T-slots 26. It will be understood that the bolster 22 may include more than two shallow T-slots 24 and/or more than two deep T-slots 26. However, for convenience the description will make reference to the minimum numbers only—i.e., two each.

Figure 5:
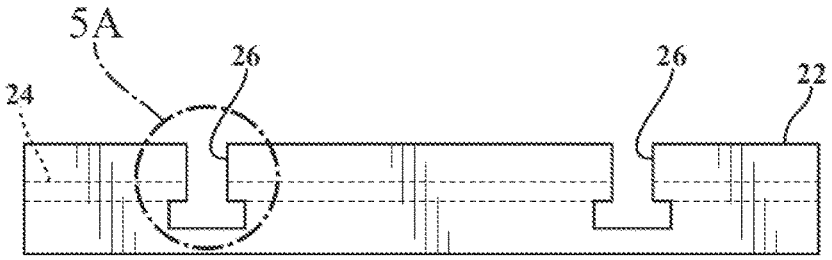
FIG. 5 is an end view of the bolster as taken generally along lines 5-5 of FIG. 3.
Figure 5A:
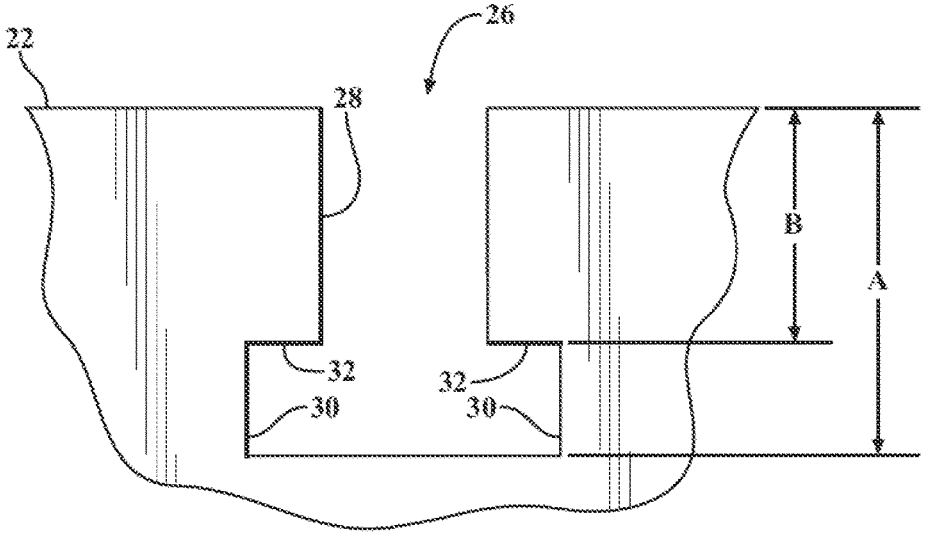
FIG. 5A is an enlarged view of the area circumscribed at 5A in FIG. 5 and calling out various dimensional attributes of a T-slot.

FIGS. 3-5 illustrate an exemplary bolster 22 supporting a minimum number of T-slots 24, 26 to implement the die transfer system 20 of this invention. Both the shallow 24 and deep 26 T-slots share many common attributes. An enlarged view of a deep T-slot 26 is provided in FIG. 5A, and will serve as a representative to explain some of the common T-slot attributes. In particular, each T-slot 24, 26 comprises a throat section 28 that opens into the face of the bolster 22. A pair of recessed undercut sections 30 are formed at the bottom of the throat section 28. These features 28, 30 take the shape of a generally inverted T when viewed in cross-section or in profile as in FIG. 5A. The horizontal interface between each undercut section 30 and the adjacent throat section 28 comprises a shoulder stop 32. The throat section 28 opens upwardly into the bolster 22 face in the form of an elongated slot. In the illustrated embodiments, the depth of the shallow T-slots 24 may be generally equal to the throat section 28 depth of the deep T-slots 26. In this manner, the overall depth of the shallow T-slots 24 is less than the overall depth of the deep T-slots. For the sake of clarity, the overall depth is indicated by reference dimension A in FIG. 5A, and the depth of the throat section 28 is indicated by reference dimension B. It should be appreciated that the adjectives "shallow" and "deep" are intended mainly to distinguish the T-slots 24, 26 one from the other in the accompanying illustrations, rather than impose strict definitional limitations. That is to say, it is possible that the shallow T-slots 24 could be designed to have an equal or greater depth in the bolster 22 than the deep T-slot formations 26.

Figure 1:
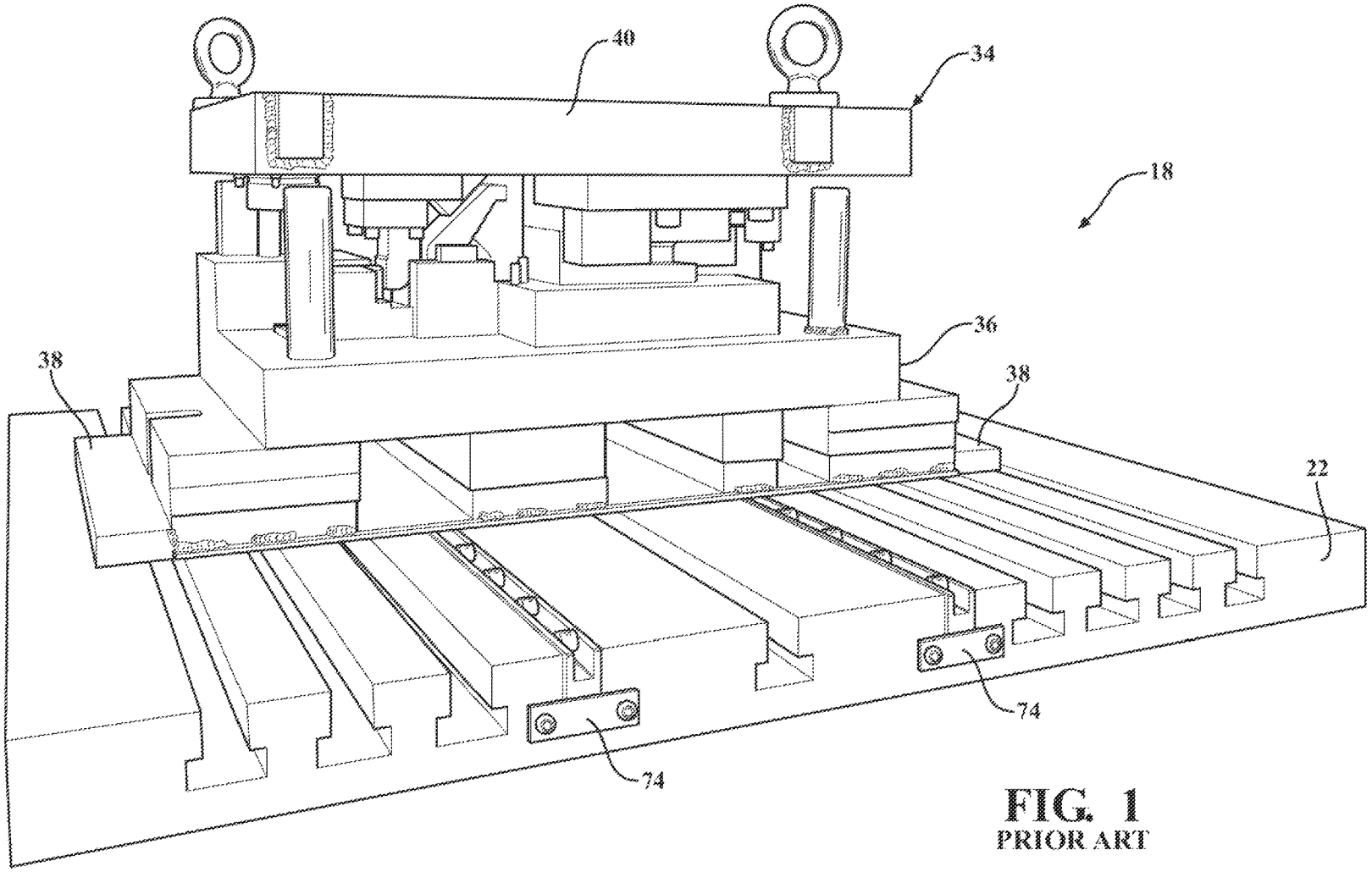
FIG. 1 PRIOR ART
FIG. 1 is a perspective view of a prior art die lifting system integrated into the bolster portion of a press machine, and further depicting an exemplary forming die resting on the bolster.

A forming die 34 is disposed on top of the bolster 22, i.e., between bolster 22 and the ram, for forming work-parts to shape according to the type of press machine 18 in which it is operating. The forming die 34, depicted in the prior art example of FIG. 1, includes a lower die member 36. The lower die member 36 has a generally flat bottom surface configured to rest in surface-to-surface contact against the face of the bolster 22, and is there held fast using various methods like clamps or magnets (not shown) engaged through ancillary T-slots (like that shown in FIG. 1) in the traditional manner. A mounting flange 38 may be provided, at least partially surrounding the bottom surface of the lower die member 36, to provide convenient clamping methods. Therefore, using any suitable method, the lower die member 36 is held immobile on the bolster 22 during a forming operation. A fragmentary portion of a lower die member 36 is visible in FIGS. 12-14. The forming die 34 also commonly includes an upper die member 40 affixed to the ram and moveable therewith so as to reciprocate against the lower die member 36 to shape work-parts therebetween.

Figure 6:
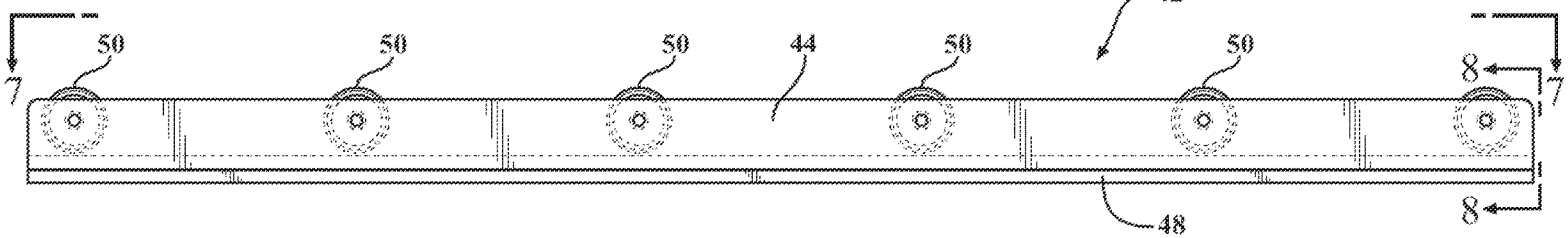
FIG. 6 is a front elevation view of a primary roller rail according to one exemplary embodiment of the invention.
Figure 7:
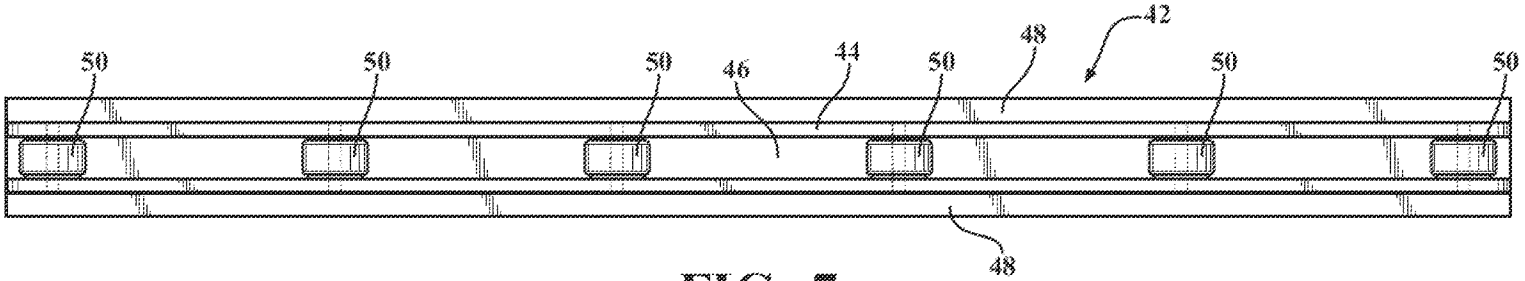
FIG. 7 is a top view of the primary roller rail as taken generally along lines 7-7 of FIG. 6.
Figure 8:
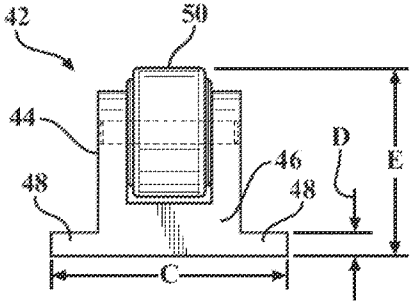
FIG. 8 is an end view of the primary roller rail as taken generally along lines 8-8 of FIG. 6.

Turning now to FIGS. 6-8, a primary roller rail, generally indicated at 42, is disposed in each shallow T-slot 24. In many cases each primary roller rail 42 will have a length generally equal to the length of the respective shallow T-slots 24. That is, the primary roller rail 42 may substantially fill the full length of its host shallow T-slot 24. Of course, there may be applications where the length of the primary roller rail 42 is shorter or longer than the length of its respective T-slot 24. Each primary roller rail 42 comprises an elongated U-channel 44 supported over a primary base plate 46. The primary base plate 46 is shown as an integral formation with the U-channel 44. That is to say, both features may be milled or extruded from a common piece of stock. Alternatively, the primary base plate 46 and U-channel 44 could be separately formed as loose pieces and subsequently attached as by welding or fasteners. The U-channel 44 fits within the throat section 28 of the host shallow T-slot 24, whereas the primary base plate 46 is contained within the opposing undercut sections 30. Each primary base plate 46 includes a pair of laterally extending primary flanges 48. A lateral measurement across the primary flanges 48 comprises a primary flange width C. The height of the primary flanges 48 comprises a primary flange thickness D. Vertical movement of each primary roller rail 42 within its respective shallow T-slots 24 is constrained by the shoulder stops 32. That is to say, the primary flanges 48 are free to move vertically a limited distance within the opposing undercut sections 30, because the height of the undercut sections 30 is greater than the primary flange thickness D. A plurality of primary roller elements 50 are spaced in generally equal longitudinal increments along the length of each primary roller rail 42. The primary roller elements 50 are supported on pins or bearings or bushings or in some other manner within the U-channel 44 to enable free rotation about generally horizontal axes. The overall height E of the primary roller rail 42 is smaller than the overall depth A of the shallow T-slots 24.

FIGS. 2 and 12-14 show an elongated first airbag 52 disposed within each shallow T-slot. The first airbags 52 are located below respective primary roller rail 42, in a manner similar to that shown and described in the aforementioned U.S. Pat. No. 5,947,676. Any suitable material can be used to construct the first airbags 52, including but not limited to spun polyester lined with a thermoplastic polyurethane (TPU) material. The first airbags 52 are configured to be inflated to an inflated height in response to receiving a supply of compressed air. In so doing, the overlying primary roller rail 42 is elevated within the associated shallow T-slots 24. As will be described below in connection with FIGS. 12-14, the roller elements 50 protrude above the bolster 22 face when its associated first airbag 52 is inflated, and conversely the roller elements 50 retract below (or at least generally flush with) the bolster 22 face when its associated first airbag 52 is deflated.

Figure 9:
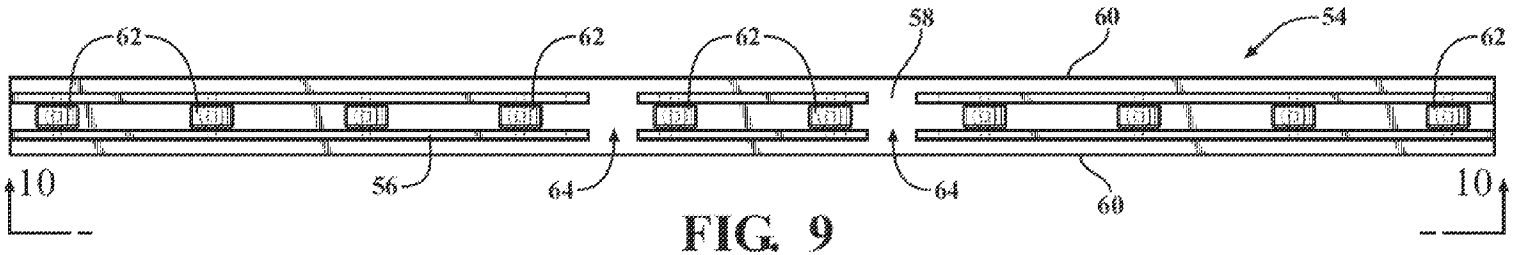
FIG. 9 is a top view of a secondary roller rail according to one exemplary embodiment of the invention.
Figure 10:
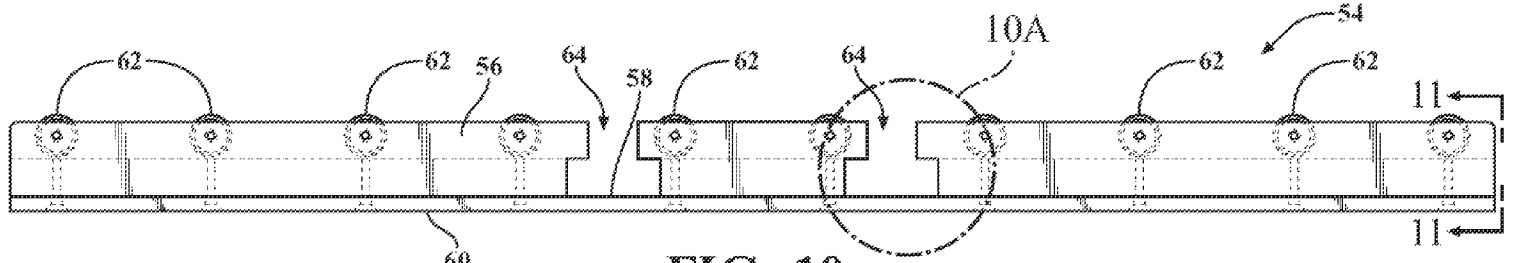
FIG. 10 is a front elevation view of the secondary roller rail as taken generally along lines 10-10 of FIG. 9.
Figure 11:
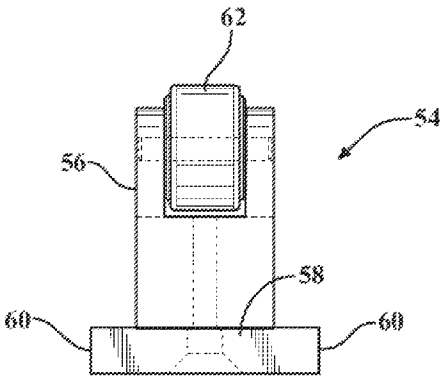
FIG. 11 is an end view of the secondary roller rail as taken generally along lines 11-11 of FIG. 10.

A secondary roller rail is generally indicated at 54 in FIGS. 9-11. One secondary roller rail 54 is disposed in each deep T-slot 26. Like the primary roller rails 42, the deep T-slots 26 may or may not have a length that is generally equal to the length of its host deep T-slots 26. Each secondary roller rail 54 has an elongated U-channel 56 supported over a secondary base plate 58. The secondary base plate 58 is shown attached to the U-channel 44 using fasteners. As previously suggested in connection with the primary base plate 46 and U-channel 44, the secondary base plate 58 and U-channel can be separately formed as loose pieces and subsequently attached as by welding or other methods. Alternatively, the primary base plate 46 and U-channel 44 can be formed as a monolithic structure from a common piece of stock. The secondary base plate 58 includes a pair of laterally extending secondary flanges 60 that nest within the opposing undercut sections 30 of the deep T-slots 26. Each secondary roller rail 54 includes a plurality of secondary roller elements 62 spaced in generally equal longitudinal increments along the length thereof. The secondary roller elements 62 are supported within the U-channel 56 for free rotation about generally horizontal axes. The overall height E of the secondary roller rail 54 is smaller than the overall depth A of the deep T-slots 26. Vertical movement of each secondary roller rail 54 within its host deep T-slot 26 is constrained by the secondary flanges 60 interacting with the shoulder stops 32.

Figure 10A:
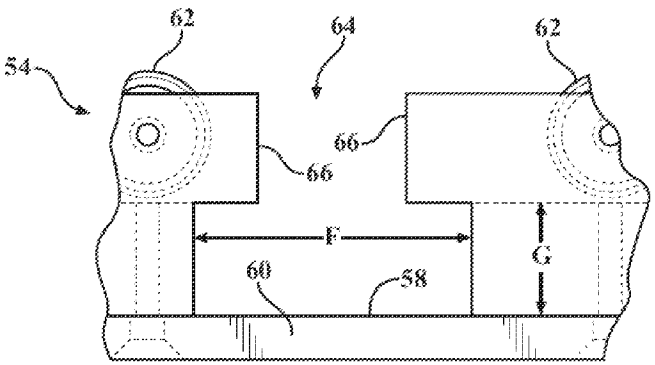
FIG. 10A is an enlarged view of the area circumscribed at 10A in FIG. 10 and calling out various dimensional attributes of a specially configured discontinuity in the secondary roller rail.
Figure 13:
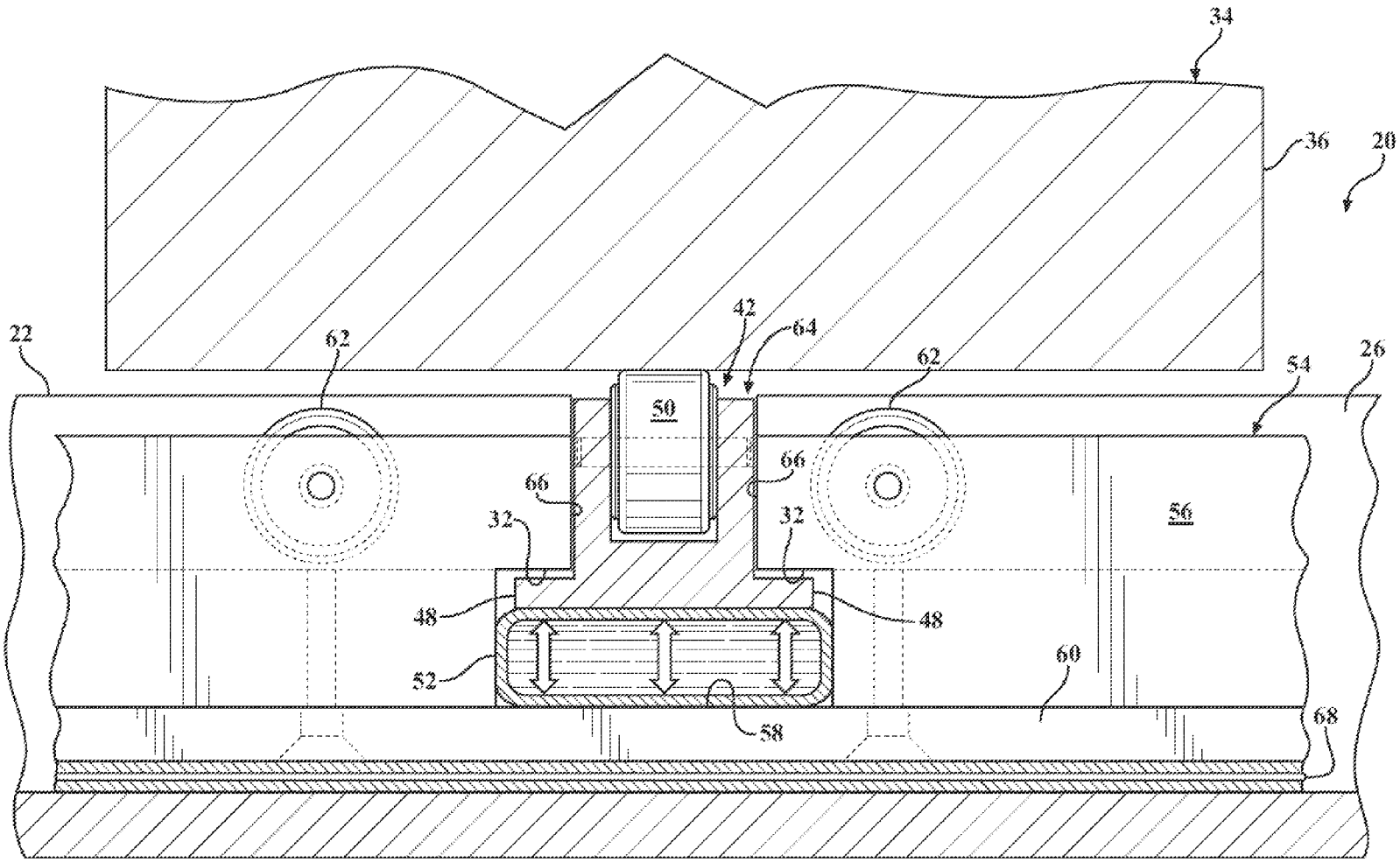
FIG. 13 is a view as in FIG. 12, but showing the primary roller rail elevated by inflating the underlying first airbag to lift the forming die by the primary roller elements.

Unlike the primary roller rails 42, each secondary roller rail 54 includes a plurality of discontinuities 64 in the U-channel, as perhaps best shown in FIGS. 10 and 10A. The number of discontinuities 64 corresponds to at least the number of primary roller rails 42. If the die transfer system 20 utilizes two primary roller rails 42 (the minimum number), then each secondary roller rail 54 will have at least two discontinuities. If, in another example, the die transfer system 20 utilizes four primary roller rails 42 then each secondary roller rail 54 will have at least four discontinuities, and so forth. Each discontinuity 64 corresponding to a respective one of the primary roller rails. Each discontinuity 64 is under-girded by the secondary base plate 58. That is to say, the secondary base plate 58 is generally continuous along the length of the secondary roller rail 54 and thus spans the discontinuities 64. Each discontinuity 64 has a longitudinal gap spacing F. The longitudinal gap spacing F is at least as large as the primary flange width C in order to receive a transversely oriented primary roller rail 42 in the discontinuity 64. The first airbags 52 must also fit within the longitudinal gap spacing F. Opposing cantilever sections 66 of the U-channel 56 project into each discontinuity 64 to form a generally inverted T-shaped negative space clearly visible in the enlarged elevation view of FIG. 10A. The distance G between the secondary base plate 58 and the overhang of the cantilever sections 66 is generally equal to or greater than the inflated height of the first airbag 52 plus the primary flange thickness D, as shown in FIG. 13.

An elongated second airbag 68 is disposed in each deep T-slot 26, below a respective secondary roller rail 54. The second airbags 68 can be fabricated from any suitable material, including but not limited to spun polyester lined with a thermoplastic polyurethane (TPU). Like the first airbags 52, the second airbags 68 are configured to inflate in response to receiving a supply of compressed air and thereby elevate their respective secondary roller rails 54 within the associated deep T-slots 26 so that the secondary roller elements 62 protrude above the face of the bolster 22. See FIG. 14.

Returning to FIG. 2, a schematic representation of an air manifold 70 is shown in fluid communication with a supply of compressed air 72. The air manifold 70 is operatively connected to each of the first 52 and second 68 airbags to selectively admit air into either the first airbags 52 or into the second airbags 68. In this manner, the first 54 and second 68 are to alternately inflate so that their associated primary 42 and secondary 54 roller rails lift above the face of the bolster 22. End caps 74 may be used to retain the primary roller rails 42 in their respective shallow T-slots 24, in much the same way illustrated in the prior art example of FIG. 1. The end caps 74 shown in FIG. 1 at least partially cover the longitudinal ends of each T-slot 24, 26, thereby allow access for the air supply but inhibiting egress of the components from their host T-slots 24, 26.

An exemplary installation process may take the following sequence. The second airbags 68 are slid or otherwise placed into the bottom of the deep T-slots 26. Next, the secondary roller rails 54 are slid into the respective deep T-slots 26, overtop of the second airbags 68. Care is taken to align the discontinuities 64 with the intersecting shallow T-slots 24. Although not shown, buffers can of course be placed between airbags and roller rails if desired. Next, the first airbags 52 are placed into the respective shallow T-slots 24. At the intersection of the deep T-slots 26, the first airbags 52 overlay the secondary base plates 58 of the secondary roller rails 54. The primary roller rails 42 can then be inserted into their respective shallow T-slots 24 over the first airbags 52. Air connections can be made to the manifold 70 to enable air from the source 72 to selectively fill the airbags 52, 68. End caps 74 (as in FIG. 1) can be installed to the bolster 22 to retain the roller rails 42, 54 in the respective T-slots 24, 26.

Figure 12:
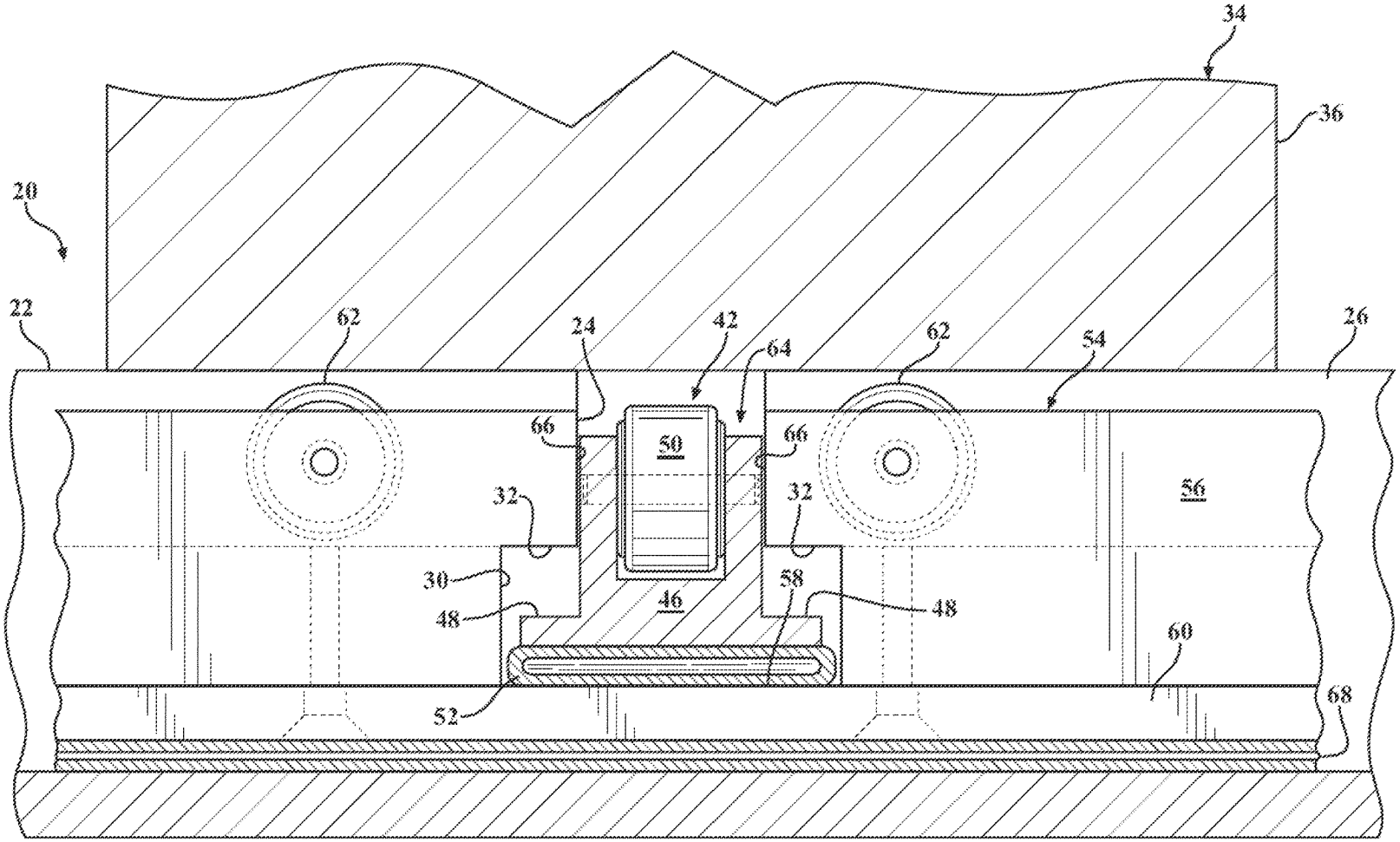
FIG. 12 is an enlarged fragmentary cross-sectional view of a bolster taken generally along lines 12-12 in FIG. 2, and showing both a primary roller rail and a secondary roller rail in retracted, non-inflated positions so that a forming die thereabove rests in surface-to-surface contact against the face of the bolster.

Operation of the die transfer system will be described according to the illustrated exemplary embodiment. FIG. 12 represents a fragmentary section taken through the bolster 22 generally along the lines 12-12 in FIG. 2. A primary roller rail 42 appears in cross-section along with an intersecting portion of a secondary roller rail 54. The lower die member 36 of a forming die 34 is shown resting on the face of the bolster 22, as may be the case when the forming die 34 is secured in place and in use shaping or cutting workparts. In this condition, both of the primary 42 and secondary 54 roller rails are lowered in their respective T-slots 24, 26 such that their respective roller elements 50, 62 are recessed below the face of the bolster 22. The roller elements 50, 62 have no affect or interaction with the forming die 34 in this condition.

When it is desired to move the forming die 34 from its seated position in FIG. 12, an operator will disable any clamps or other fastening elements that may be locking the forming die 34 to the bolster 22. Next, the operator activates the air manifold 70 to selectively admit air into either the first airbag 52 or into the second airbag 68. It is not expected that air would be admitted to both airbags 52, 68 simultaneously, however it is possible that is some alternative constructions that may be desirable. However, in normal usage, the operator will choose to energize only the first airbag 52 if it is desired to move the forming die 34 in the longitudinal direction of the shallow T-slots 24. Alternatively, the operator will choose to energize only the second airbag 68 if it is desired to move the forming die 34 in the longitudinal direction of the deep T-slots 26.

FIG. 13 represents the situation where the operator wants to move the forming die 34 in the longitudinal direction of the shallow T-slots 24. In this case, the operator manipulates the control valve features of the air manifold 70 to admit compressed air (from source 72) into all of the first airbags 52, which simultaneously deflates (either actively or passively) the second airbags 68. The influx of compressed air causes the first airbags 52 to inflate, upwardly pushing the associated primary roller rails 42. The uppermost tangential edges of the primary roller elements 50 will press into the bottom of the lower die member 36, causing the entire forming die 34 to lift above the face of the bolster 22. Once raised out of frictional contact with the bolster 22, the forming die 34 is easily moved along the primary roller elements 50 by human power alone. In this manner, the operator can re-position the forming die 34 on the bolster 22, or move the forming die 34 onto an adjacent waiting bolster extension (not shown) or transfer cart (not shown).

Of particular note in FIG. 13 is the interaction between the primary 42 and secondary 54 roller rails. Because the first airbags 52 extend over top of the secondary base plates 58, when inflated the secondary roller rails 54 are pushed down with forces exerted on the primary roller rails 42. This initially helps to retract or push the secondary roller rails 54 toward the bottoms of their respective deep T-slots 26, forcefully expelling any residual air contained within the second airbags 68. However, when the primary flanges 48 are raised to the point of contacting the cantilever sections 66, the downward forces are immediately counter-balanced and the upward travel of the primary roller rails 42 arrested at an upper limit. Depending on tolerances and design specifications, in some embodiments the upward travel of the primary roller rails 42 may be limited by the shoulder stops 32 in the respective host shallow T-slots 24 rather than by the cantilever sections 66.

Figure 14:
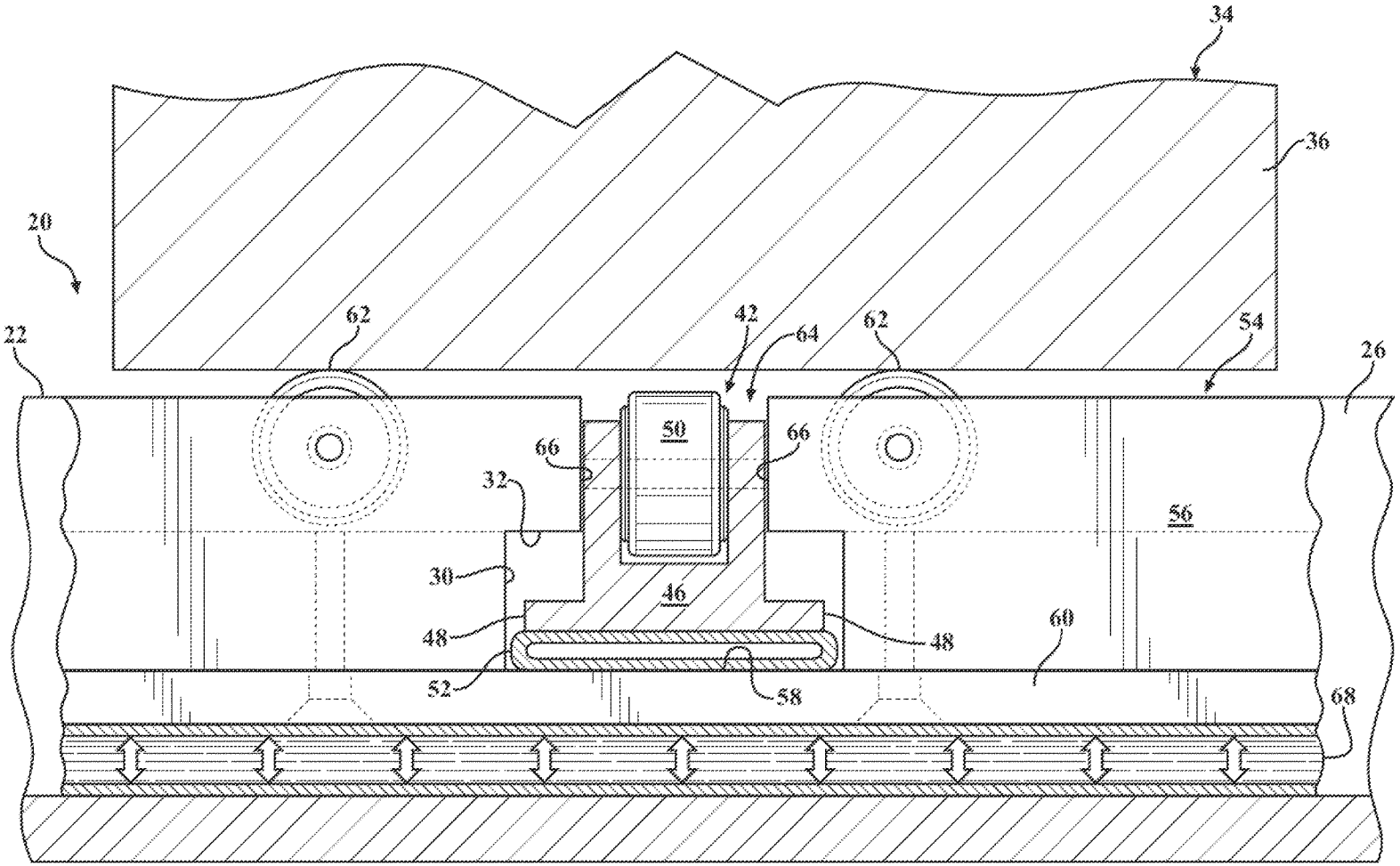
FIG. 14 is a view as in FIG. 12, but showing the secondary roller rail elevated by inflating the underlying second airbag to raise the forming die by the secondary roller elements.

FIG. 14 represents the situation where the operator wants to move the forming die 34 in the longitudinal direction of the deep T-slots 26. To accomplish this, the operator manipulates the control valve features of the air manifold 70 to admit compressed air into all of the second airbags 68, which concurrently enables deflation of the first airbags 52. The influx of compressed air causes the second airbags 68 to inflate, upwardly pushing the associated secondary roller rails 54. The uppermost tangential edges of the secondary roller elements 62 will press into the bottom of the lower die member 36, causing the entire forming die 34 to lift above the face of the bolster 22. Now, the forming die 34 is easily moved along the secondary roller elements 62 by human power alone for re-positioning or service to the forming die 34.

Unlike prior art systems that require a large number of roller rails to accomplish die movement in perpendicular directions, or that require complicated bolster fabrications and/or complicated installation procedures, or that in some other way are generally ill-suited to modern-day press machine operations, the die transfer system 20 of the present invention can be constructed at relatively low-cost, is easy to install and maintain, and is robust in operation.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. A pneumatic die transfer system for a press machine, said system comprising:

at least two primary roller rails disposed parallel to one another, each said primary roller rail comprising an elongated U-channel supported over a primary base plate, each said primary base plate including a pair of laterally extending primary flanges, a lateral measurement across said primary flanges comprising a primary flange width, the height of said primary flanges comprising a primary flange thickness, at least two elongated first airbags, each said first airbag disposed below a respective one of said primary roller rails, each said first airbag configured to inflate to an inflated height in response to an admittance of compressed air and thereby elevate the respective said primary roller rail, at least two secondary roller rails disposed parallel to one another, each said secondary roller rail comprising an elongated U-channel supported over a secondary base plate, at least two elongated second airbags, each said second airbag disposed below a respective one of said secondary roller rails, each said second airbag configured to inflate in response to an admittance of compressed air and thereby elevate the respective said secondary roller rail, each said secondary roller rail including a plurality of discontinuities in said U-channel thereof, each said discontinuity corresponding to a respective one of said primary roller rails, each said discontinuity being under-girded by said secondary base plate, each said discontinuity having a longitudinal gap spacing, said longitudinal gap spacing being at least as large as said primary flange width in order to receive in said discontinuity and above said under-girded secondary base plate a transversely oriented one of said primary rails together with the respective said first airbag, whereby said at least two primary roller rails intersect passing directly through said at least two secondary roller rails in a grid pattern while remaining selectively operable by the respective said first and second airbags to facilitate manual transfer of a forming die in the linear direction of either the primary or secondary roller rails.

2. The system of claim 1, wherein each said primary roller rail includes a plurality of primary roller elements spaced in generally equal longitudinal increments along the length thereof, said primary roller elements supported within said U-channel for free rotation about generally horizontal axes, and wherein each said secondary roller rail includes a plurality of secondary roller elements spaced in generally equal longitudinal increments along the length thereof, said secondary roller elements supported within said U-channel for free rotation about generally horizontal axes.

3. The system of claim 2, further including opposing cantilever sections of said U-channel projecting into each said discontinuity to form a generally inverted T-shaped negative space.

4. The system of claim 3, wherein the distance between said secondary base plate and said opposing cantilever sections is generally equal to or greater than the inflated height of said first airbag plus said primary flange thickness.

5. A die transfer system for a press machine, said system comprising:

a bolster having a generally horizontal face, a plurality of T-slots formed in said face of said bolster, said plurality of T-slots comprising at least two shallow T-slots and at least two deep T-slots, each of said T-slots having a respective length, said at least two shallow T-slots disposed parallel to one another, said at least two deep T-slots disposed parallel to one another, a primary roller rail disposed in each of said shallow T-slots, each said primary roller rail having a length generally equal to the length of said respective shallow T-slots, each said primary roller rail comprising an elongated U-channel supported over a primary base plate, each said primary base plate including a pair of laterally extending primary flanges, a lateral measurement across said primary flanges comprising a primary flange width, the height of said primary flanges comprising a primary flange thickness, said primary flanges being fitted within said opposing undercut sections of said shallow T-slots, vertical movement of each said primary roller rail within the respective said shallow T-slot being constrained by said shoulder stops, an elongated first airbag disposed within each said shallow T-slot, each said first airbag disposed below a respective said primary roller rail, each said first airbag being configured to inflate to an inflated height in response to receiving a supply of compressed air and thereby elevate the respective said primary roller rail within said associated shallow T-slot so that the plurality of roller elements protrude above said bolster face, an elongated second airbag disposed within each said deep T-slot, each said second airbag disposed below the respective said secondary roller rail, each said second airbag being configured to inflate in response to receiving a supply of compressed air and thereby elevate the respective said secondary roller rail within said associated deep T-slot so that the plurality of roller elements protrude above said bolster face, said at least two shallow T-slots perpendicularly intersecting and passing directly through said at least two deep T-slots, and a secondary roller rail disposed in each of said deep T-slots, each said secondary roller rail comprising an elongated U-channel supported over a secondary base plate, each said secondary roller rail including a plurality of discontinuities in said U-channel, each said discontinuity corresponding to a respective one of said primary roller rails, each said discontinuity being under-girded by said secondary base plate, each said discontinuity having a longitudinal gap spacing, said longitudinal gap spacing being at least as large as said primary flange width in order to receive in said discontinuity a transversely oriented said primary rail together with a respective said first airbag.

6. The system of claim 5, wherein each said primary roller rail includes a plurality of primary roller elements spaced in generally equal longitudinal increments along the length thereof, said primary roller elements supported within said U-channel for free rotation about generally horizontal axes, and wherein each said secondary roller rail includes a plurality of secondary roller elements spaced in generally equal longitudinal increments along the length thereof, said secondary roller elements supported within said U-channel for free rotation about generally horizontal axes.

7. The system of claim 6, further including opposing cantilever sections of said U-channel projecting into each said discontinuity to form a generally inverted T-shaped negative space.

8. The system of claim 7, wherein the distance between said secondary base plate and said opposing cantilever sections is generally equal to or greater than the inflated height of said first airbag plus said primary flange thickness.

9. The system of claim 5, wherein the overall height of said secondary roller rail is smaller than the overall depth of said deep T-slots.

10. The system of claim 9, wherein each said secondary roller rail has a length generally equal to the length of said respective deep T-slots.

11. The system of claim 9, wherein the overall height of said primary roller rail is smaller than the overall depth of said shallow T-slots.

12. The system of claim 5, wherein each said T-slot comprises a throat section and a pair of opposing undercut sections forming a generally inverted T-shaped cross-sectional profile, the interface between each undercut section and the adjacent throat section comprising a shoulder stop, said throat section opening upwardly into said bolster face, and wherein each said secondary base plate includes a pair of laterally extending secondary flanges, said secondary flanges fitted within said opposing undercut sections of said deep T-slots, vertical movement of each said secondary roller rail within the respective said deep T-slot being constrained by said shoulder stops.

13. The system of claim 12, the depth of said shallow T-slots being generally equal to the throat section depth of said deep T-slots.

14. The system of claim 5, further including an air manifold in fluid communication with a supply of compressed air, said air manifold operatively connected to each of said first and second airbags to selectively admit air into said first airbags or into said second airbags to alternately inflate said first and second airbags.

15. The system of claim 14, wherein each said first airbag is fabricated from spun polyester, each said first airbag being lined with a thermoplastic polyurethane (TPU), and each said second airbag is fabricated from spun polyester, each said second airbag being lined with a thermoplastic polyurethane (TPU).

16. The system of claim 5, further including end caps affixed to said bolster and at least partially covering the longitudinal ends of each said T-slot.

17. The system of claim 5, further including a lower die member affixed to said bolster, said lower die member having a generally flat bottom surface configured to rest in surface-to-surface contact against said face of said bolster.

18. A die transfer system for a press machine, said system comprising:

a press machine, said press machine including a bolster having a generally horizontal face, a plurality of T-slots formed in said face of said bolster, said plurality of T-slots comprising at least two shallow T-slots and at least two deep T-slots, each of said T-slots having a respective length, said at least two shallow T-slots disposed parallel to one another, said at least two deep T-slots disposed parallel to one another, each said T-slot comprising a throat section and a pair of opposing undercut sections forming a generally inverted T-shaped cross-sectional profile, the interface between each undercut section and the adjacent throat section comprising a shoulder stop, said throat section opening upwardly into said bolster face, the depth of said shallow T-slots being generally equal to the throat section depth of said deep T-slots, end caps at least partially covering the longitudinal ends of each said T-slot, a lower die member affixed to said bolster, said lower die member having a generally flat bottom surface configured to rest in surface-to-surface contact against said face of said bolster, a mounting flange at least partially surrounding said bottom surface of said lower die member, a primary roller rail disposed in each of said shallow T-slots, each said primary roller rail having a length generally equal to the length of said respective shallow T-slots, each said primary roller rail comprising an elongated U-channel supported over a primary base plate, each said primary roller rail including a plurality of primary roller elements spaced in generally equal longitudinal increments along the length thereof, said primary roller elements supported within said U-channel for free rotation about generally horizontal axes, the overall height of said primary roller rail being smaller than the overall depth of said shallow T-slots, each said primary base plate including a pair of laterally extending primary flanges, a lateral measurement across said primary flanges comprising a primary flange width, the height of said primary flanges comprising a primary flange thickness, said primary flanges being fitted within said opposing undercut sections of said shallow T-slots, vertical movement of each said primary roller rail within the respective said shallow T-slot being constrained by said shoulder stops, an elongated first airbag disposed within each said shallow T-slot, each said first airbag disposed below a respective said primary roller rail, each said first airbag being configured to inflate to an inflated height in response to receiving a supply of compressed air and thereby elevate the respective said primary roller rail within said associated shallow T-slot so that the plurality of roller elements protrude above said bolster face, an elongated second airbag disposed within each said deep T-slot, each said second airbag disposed below the respective said secondary roller rail, each said second airbag being configured to inflate in response to receiving a supply of compressed air and thereby elevate the respective said secondary roller rail within said associated deep T-slot so that the plurality of roller elements protrude above said bolster face, an air manifold in fluid communication with a supply of compressed air, said air manifold operatively connected to each of said first and second airbags to selectively admit air into said first airbags or into said second airbags to alternately inflate said first and second airbags, wherein the improvement comprises:

said at least two shallow T-slots perpendicularly intersecting and passing directly through said at least two deep T-slots, a secondary roller rail disposed in each of said deep T-slots, each said secondary roller rail having a length generally equal to the length of said respective deep T-slots, each said secondary roller rail comprising an elongated U-channel supported over a secondary base plate, each said secondary roller rail including a plurality of secondary roller elements spaced in generally equal longitudinal increments along the length thereof, said secondary roller elements supported within said U-channel for free rotation about generally horizontal axes, the overall height of said secondary roller rail being smaller than the overall depth of said deep T-slots, each said secondary base plate including a pair of laterally extending secondary flanges, said secondary flanges fitted within said opposing undercut sections of said deep T-slots, vertical movement of each said secondary roller rail within the respective said deep T-slot being constrained by said shoulder stops, each said secondary roller rail including a plurality of discontinuities in said U-channel, each said discontinuity corresponding to a respective one of said primary roller rails, each said discontinuity being under-girded by said secondary base plate, each said discontinuity having a longitudinal gap spacing, said longitudinal gap spacing being at least as large as said primary flange width in order to receive in said discontinuity a transversely oriented said primary rail together with a respective said first airbag.

19. The system of claim 18, further including opposing cantilever sections of said U-channel projecting into each said discontinuity to form a generally inverted T-shaped negative space, the distance between said secondary base plate and said opposing cantilever sections being generally equal to or greater than the inflated height of said first airbag plus said primary flange thickness.

20. The system of claim 18, wherein each said first airbag is fabricated from spun polyester, each said first airbag being lined with a thermoplastic polyurethane (TPU), and each said second airbag is fabricated from spun polyester, each said second airbag being lined with a thermoplastic polyurethane (TPU).

* * * * *